United States Patent [19]

Eggert, Jr.

[11] 4,438,703

[45] Mar. 27, 1984

[54] PRIMARY SUSPENSION SYSTEM FOR A RAILWAY CAR

[75] Inventor: Walter S. Eggert, Jr., Huntington Valley, Pa.

[73] Assignee: The Budd Company, Troy, Mich.

[21] Appl. No.: 348,446

[22] Filed: Feb. 12, 1982

[51] Int. Cl.[3] ..... B61F 5/26

[52] U.S. Cl. ..... 105/224.1; 267/3; 267/153

[58] Field of Search ..... 105/224.1; 267/3, 63 R, 267/153

[56] References Cited

U.S. PATENT DOCUMENTS

| | | | |
|---|---|---|---|
| 2,100,065 | 11/1937 | Buckwalter | 105/224.1 |
| 3,276,395 | 10/1966 | Heintzel | 105/224.1 |
| 3,720,175 | 3/1973 | Russell-French | 105/224.1 |
| 3,777,672 | 12/1973 | Schneider | 105/224.1 |
| 4,044,689 | 8/1977 | Eggert, Jr. | 105/224.1 |
| 4,044,977 | 8/1977 | Feucht | 267/153 X |
| 4,132,430 | 1/1979 | Bantle | 267/63 R |

*Primary Examiner*—Randolph Reese
*Assistant Examiner*—Gregory A. Beehner
*Attorney, Agent, or Firm*—Edward M. Farrell; Herman Foster; Thomas I. Davenport

[57] ABSTRACT

A primary suspension system is disposed between a wheel journal bearing and a side frame of a railway truck to minimize acceleration forces from being transmitted from a wheel axle unit to a car body. A pair of elastomeric members form a ring clamped around the journal bearing and are bonded to multiple outer plates disposed in different planes. Relatively low spring rates are provided when one set of outer multiple plates are operative with relatively high spring rates being provided when the elastomeric members are compressed and the inner multiple plates become operative.

5 Claims, 4 Drawing Figures

PRIMARY SUSPENSION SYSTEM FOR A RAILWAY CAR

BACKGROUND OF THE INVENTION

An example of a primary suspension system somewhat similar to the one involved in this application may be found in copending patent application entitled "Primary Suspension System for a Railway Car", Ser. No. 296,796, filed Aug. 27, 1981, assigned to the same assignee as the present invention.

There are presently in use railway cars in which the primary suspension system includes rubber so called shock rings fitted around the journal bearing assemblies between the bearing assemblies and the side frames of the truck. The rubber rings are compressed and clamped between the journals and side frames. Because of the arrangement used, very high vertical and longitudinal stiffnesses result, in the order of about 100,000 pounds per inch.

Relatively high vertical stiffness in the primary suspension systems results in very little attenuation of the wheel accelerations to the truck frame. The relatively high longitudinal stiffness tends to maintain the axle positions or wheel bases within the truck frame.

Tests have indicated that reducing the vertical stiffness in the primary suspension systems reduces the accelerations transmitted from the wheels to the truck frame. This tends to increase the useful life of the truck mounted equipment.

Tests have also indicated that reducing the longitudinal stiffness in the primary suspension system permits the axles on the truck to assume a more radial position with respect to the tracks when making turns. This reduces the angle of attack of the wheel flanges with respect to the tracks thereby reducing lateral wheel forces. The result is reduction of wheel and flange wear and longer life.

The aforementioned application discloses a primary suspension system including rubber rings disposed between wheel journal bearing assemblies and the side frame of a railway truck. The rubber rings have cutaway portions or openings therein bonded to inner and outer split metal rings. The openings in the rings provide relatively low spring rates for the suspension system.

While the suspension system of the aforementioned application is satisfactory, it is sometimes desirable to provide a soft spring rate up to a certain level and a somewhat harder spring rate beyond a certain level to accommodate very high loads and to minimize gross deflections during operation. This is because the rubber or elastomeric material with openings therein may not be able to carry the loads involved. At the same time, it is desirable that the changes in spring rate changes from a low spring rate to a high spring rate be accomplished smoothly without abrupt changes.

OBJECTS OF THE INVENTION

It is an object of this invention to provide an improved primary suspension system for a railway truck in which different spring rates are achieved for different loads.

It is a further object of this invention to provide a primary suspension system having a soft or high spring rate for relatively low loads and a hard or high spring rate for relatively high loads to control gross deflections.

It is still a further object of this invention to provide a primary suspension system with a first spring rate operative independently at low loads with second spring rate becoming effective when the loads exceed predetermined high levels with the transition between spring rates being accomplished smoothly with a snubbing action rather than using hard mechanical stop elements.

BRIEF SUMMARY OF THE INVENTION

In accordance with the present invention, a primary suspension system is disposed between a journal bearing and a side frame of a railway truck to minimize acceleration forces from being transmitted from a wheel axle unit to a railway car body and to minimize gross deflections in the system. Top and bottom assemblies forming a ring are disposed to be clamped around the journal bearing. The top and bottom assemblies each include elastomeric members having cavities therein bonded to pairs of outer metal plate elements disposed in proximity to the side frame and inner metal plate elements in contact with the journal bearing. The outer plate elements comprise primary and secondary plates disposed in different planes. The primary plates have open areas therein. The elastomeric members include recessed portions in their outer peripheries in alignment with the open areas of the primary plate elements. The secondary metal plates are disposed in the recessed portions. The suspension system provides a first spring rate up to a predetermined load when the outer primary metal plates are in operation and a second spring rate when said secondary recessed metal plates become operative when the elastomeric members are compressed during higher loads.

Other objects and advantages of the present invention will be apparent and suggest themselves to those skilled in the art, from a reading of the following specification and claims, taken in conjunction with the accompanying drawings.

DESCRIPTION OF THE INVENTION

The present invention may be used with a conventional railway truck. Such a railway truck generally includes side frames for receiving wheel-axle assemblies and are adapted to receive various types of equipment such as brakes, motors, gear boxes and the like. These trucks also generally include suitable journal bearing assemblies for receiving the axles of the wheel axle units. The bearing journals are generally attached through primary suspension systems including rubber rings or the like to the side frames of the truck.

Figure 1:
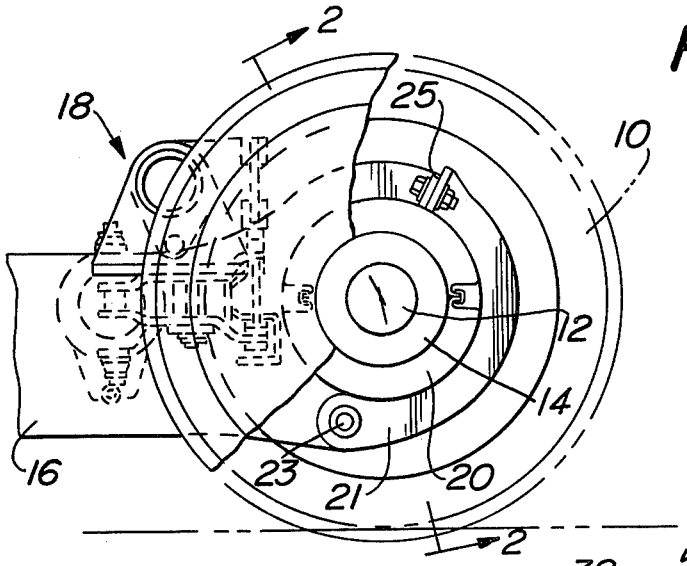
FIG. 1 is a side view of a portion of a railway truck illustrating one embodiment of the present invention.

Only a single wheel-axle assembly, journal bearing assembly and primary system is illustrated in FIG. 1, it being understood that a conventional truck would include four such similar type wheel-axle assemblies with four primary suspension systems.

A wheel axle unit includes a wheel 10 secured to an axle 12. A wheel journal bearing assembly 14 is disposed around the axle 12. The wheel-axle unit comprising the wheel 10 and axle 12 are secured to a side frame 16. Two side frames connected by a bolster often comprise a conventional truck. Various other parts of the truck, not illustrated, are designed to hold other equipment, such as braking units and other similar apparatus 18 not related to the present invention. A primary suspension system 20 is disposed between the journal bearing assembly 14 and the side frame 16 and is the subject of the present invention.

The wheel-axle assembly, including the wheel 10 and axle 12, is held to the side frame 16 by means of a clamp 21 adapted to be pivoted about a pin 23. The clamp 21, after receiving the wheel-axle assembly with the primary suspension 20, is moved to a locked position and held secured to the frame by means of locking means 25 which may include a conventional head bolt, washer and lock nut. As will be described, elastomeric members in the primary suspension system are compressed with the design of the members being such that the suspension system is centered for static loads. This requires that the top and bottom halves making up the journal ring have different degrees of softness therein, as will be described.

Figure 3:
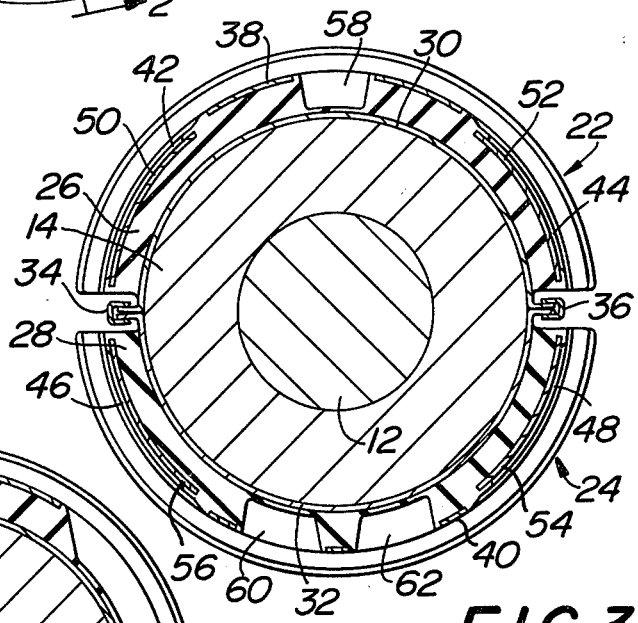
FIG. 3 is a cross-sectional view taken along lines 3—3 of FIG. 2.
Figure 4:
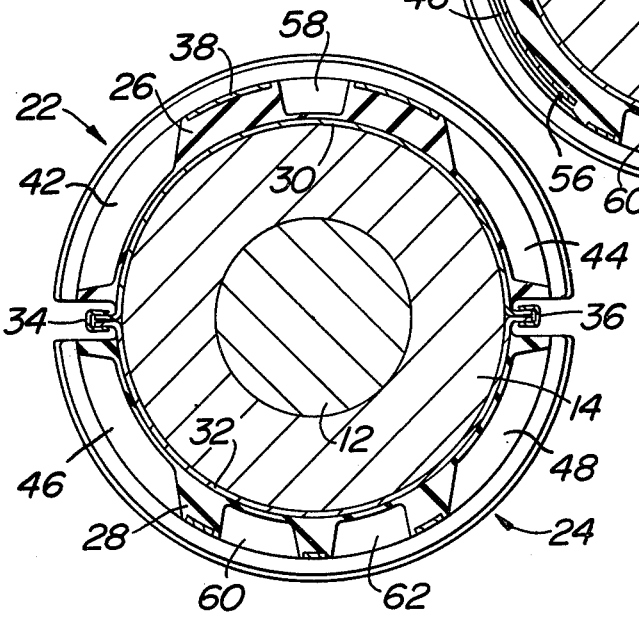
FIG. 4 is a cross-sectional view taken along lines 4—4 of FIG. 2.
Figure 2:
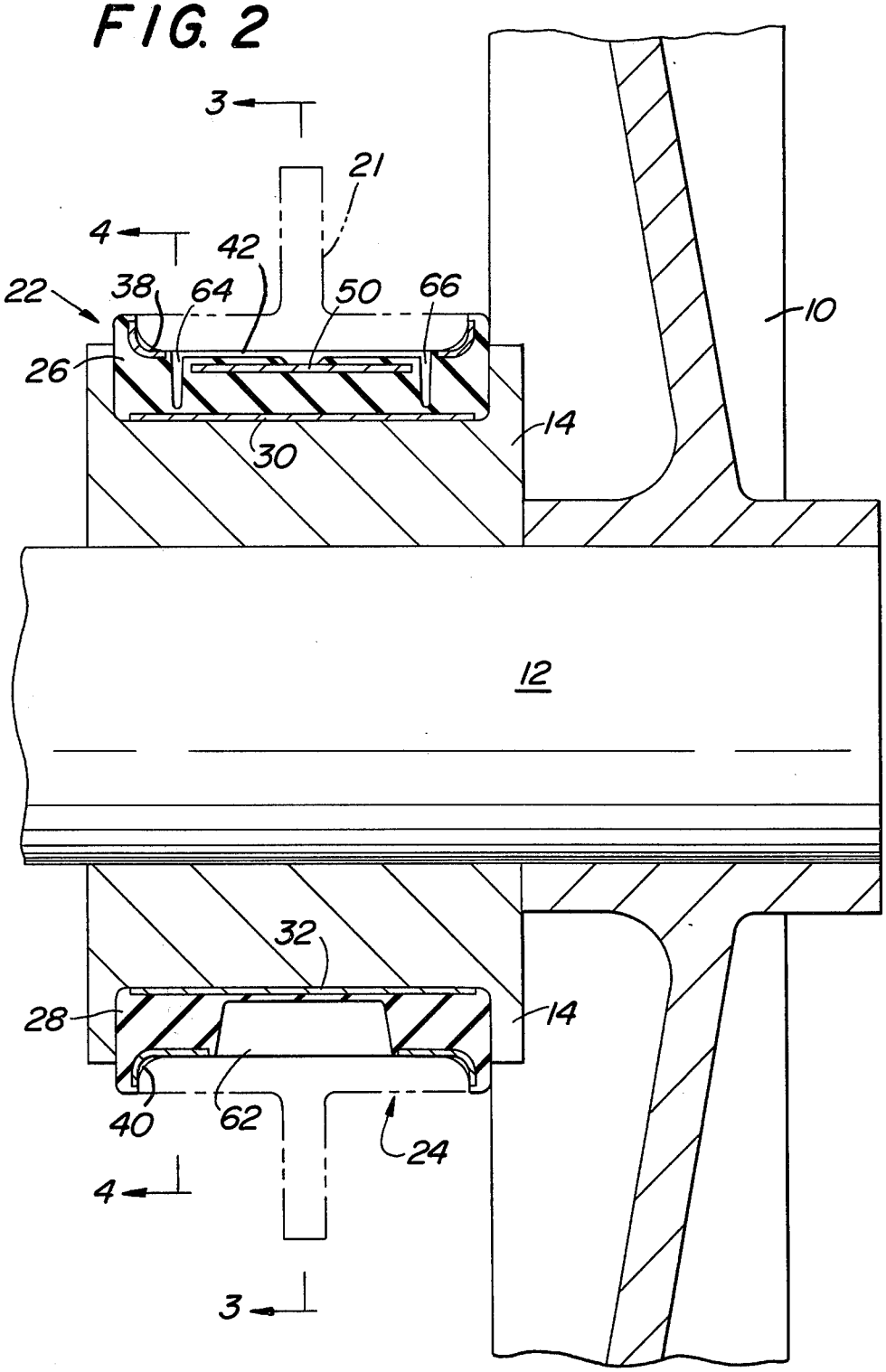
FIG. 2 is a cross-sectional view taken along lines 2—2 of FIG. 1.

Referring to FIGS. 2, 3 and 4, along with FIG. 1, the primary suspension system 20 includes top and bottom assemblies 22 and 24 which form two halves making up a ring configuration surrounding the journal bearing 14 and connected to the side frame 16 by means of the clamp 21. The assemblies 22 and 24 include top and bottom elastomeric members 26 and 28 having their inner surfaces bonded to inner metal frames or plates 30 and 32, respectively, each including projecting edges extending outwardly therefrom. A pair of clips 34 and 36 are attached over the projecting edges of the inner plates 30 and 32 to hold the assemblies 22 and 24 together to form the ring configuration prior to attachment to the side frame.

The top and bottom elastomeric members 26 and 28 have their outer surfaces bonded to outer primary metal frames or plates 38 and 40, respectively. The outer plates 38 and 40 include cut-away portions or open areas therein. Open areas 42 and 44 are provided in the top outer primary plate 38, with open areas 46 and 48 being provided in the lower primary outer plate 40.

Each of the elastomeric members 26 and 28 include recessed areas at their outer peripheries in alignment with the open areas in the outer plates 38 and 40. Upper secondary outer plates 50 and 52, which may be considered as stop plates or inserts, are bonded in the recessed areas of the top elastomeric member 26. Lower secondary outer plates 54 and 56, which may also be considered as stop plates or inserts, are bonded in the recessed areas of the bottom elastomeric member 28. The outer primary and secondary plates are in different planes with respect to each other so that the primary plates are always operative when the elastomeric members are compressed with the secondary plates in the inner plane becoming operative only when the elastomeric members are compressed beyond predetermined limits.

In addition to the recesses, the top elastomeric member 26 includes a cavity 58 therein and the bottom elastomeric member 28 includes a pair of cavities 60 and 62. A pair of grooves are provided on both sides of all the inserts 50, 52, 54 and 56, with only one such pair 64 and 66 being illustrated in FIG. 2 on opposite sides of the insert 50. These cavities and grooves provide softness in the elastomeric members so as to provide low spring rates in the system for relatively light loads.

The outer plate 38 with the stop plates 50 and 52, and outer plate 40 with stop plates 54 and 56, may be considered as multiple outer plate pieces and together perform the functions of the integral outer and inner plates used heretofore in prior art systems, as, for example, in the aforementioned copending patent application.

The outer primary plates 38 and 40 operate in different planes than the inwardly recessed secondary stop plates 50, 52, 54 and 56. During operation, with relatively low loads, the portions of the elastomeric members 26 and 28 between the inner plates and outer primary plates are compressed. The secondary stop plates within the recesses of the elastomeric members move in the recesses and in effect remain inoperative until the applied loads exceed predetermined levels. It is only after relatively heavy loads are applied and the elastomeric members become compressed beyond predetermined limits that the secondary stop plates are moved in distance of the recesses and become operative when they are disposed in the same plane as the outer primary plates.

During operation, acceleration forces produced in the wheel 10 cause the elastomeric members 26 and 28 to compress in accordance with the load forces of the accelerations. During relatively low loads only the elastomeric portions between the outer plates 38 and 40 and inner plates 30 and 32 are effective to absorb the acceleration forces. The recesses over the stop plates 50, 52, 54 and 56 offer no resistance and therefore the elastomeric portions between the stop plates 50, 52, 54 and 56 and the inner plates 30 and 32 will not be effective during low load accelerations in the wheel 10.

During high loads, some of the primary and secondary outer plates will be in the same planes with all of the elastomeric material between these outer plates involved and inner plates 30 and 32 becoming effective. This provides a high spring rate and minimizes the likelihood of gross deflections from taking place in the system.

The cavity 58 in the member 26 and the cavities 60 and 62 in the member 28 control the vertical spring rates in the suspension system. The single cavity on top controls the vertical spring rate and the two bottom cavities control the rebound rates, as when the brakes are applied, for example. These cavities provide softness in the spring system. In the aforementioned application, a plurality of openings or recesses were provided in the elastomeric ring to provide this softness.

The different number of cavities on top and bottom of the elastomeric ring makes it possible to design the suspension system so that the two half elastomeric members form a circular ring after they are clamped to the side frame. Before the members 26 and 28 are attached they are not concentric with respect to each other. Upon clamping, the elastomer members 26 and 28 are preloaded so that the same amounts of compression take place in the two elastomeric half members under a static load so that the initial operating point in the system is at the center of the ring formed by the elastomeric members 26 and 28. Different size cavities in the top and bottom elastomeric members may be employed to achieve the low spring rates desired dependent upon the car loading involved, the brake operation rebounds taking place during operation and other design considerations.

Basically, the present invention has provided a primary suspension system with different levels of operation. It accomplishes this by making the outer ring member in multiple pieces disposed at different planes on the elastomeric members.

The system provides a separation of the soft portion of the elastomeric springs from the hard portion. The soft portion is operative until the outer secondary plates bottom at which point both the outer primary and secondary plates are operative.

The transition from a soft spring rate to a hard spring rate takes place smoothly, utilizing a snubbing effect. This provides an advantage over using a physical stop or pin which would not provide a smooth transition from one spring rate to the other.

What is claimed is:

1. In a railway truck having a side frame for receiving a wheel-axle unit disposed to ride in a journal bearing, a primary suspension system clamped to said side frame between said journal bearing and said side frame comprising:

(a) top and bottom assemblies forming a ring disposed to fit around said journal bearing to minimize forces transmitted from said wheel-axle unit to said side frame;

(b) said top and bottom assemblies each including elastomeric members bonded to pairs of inner and outer plate members;

(c) said outer plate members including primary and secondary plate elements;

(d) said primary plate elements having openings therein;

(e) said elastomeric members having recessed portions on their outer peripheries aligned with the openings of said primary plate elements;

(f) said secondary plate elements being disposed in said recessed portions of said elastomeric members in different planes than primary plate elements;

whereby said suspension system provides a first spring rate up to a predetermined loading of said elastomeric members when said outer secondary plate elements are inoperative and a second higher spring rate when said secondary metal plate elements become operative when some of said elastomeric members are compressed beyond predetermined limits during high load forces.

2. A primary suspension system as set forth in claim 1, wherein cavities are provided in each of said elastomeric members.

3. A primary suspension system as set forth in claim 2 wherein a pair of grooves are provided in each of said elastomeric members on either side of said secondary plate elements.

4. A primary suspension system as set forth in claim 3 wherein said inner plate members include projecting edge portions, and a pair of clips are connected over said edge portion to secure together said top and bottom assemblies.

5. A primary suspension system as set forth in claim 4 wherein each of said outer primary plates include a plurality of openings therein aligned with a plurality of recesses in said elastomeric members each having a secondary plate element disposed therein.

* * * * *